US011638462B2

(12) United States Patent
Xanthos

(10) Patent No.: US 11,638,462 B2
(45) Date of Patent: May 2, 2023

(54) MODULAR OUTSOLE FOR ARTICLE OF FOOTWEAR

(71) Applicant: NIKE, Inc., Beaverton, OR (US)

(72) Inventor: George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/083,963

(22) Filed: Oct. 29, 2020

(65) Prior Publication Data

US 2021/0127781 A1 May 6, 2021

Related U.S. Application Data

(60) Provisional application No. 62/929,512, filed on Nov. 1, 2019.

(51) Int. Cl.

| | |
|---|---|
| ***A43B 13/16*** | (2006.01) |
| ***A43B 13/26*** | (2006.01) |
| ***A43B 13/32*** | (2006.01) |
| ***A43B 13/22*** | (2006.01) |
| ***A43B 13/14*** | (2006.01) |
| *A43C 15/16* | (2006.01) |

(52) U.S. Cl.

CPC ..... *A43B 13/16* (2013.01); *A43B 13/141* (2013.01); *A43B 13/223* (2013.01); *A43B 13/26* (2013.01); *A43B 13/32* (2013.01); *A43C 15/161* (2013.01)

(58) Field of Classification Search

CPC ..... A43B 13/16; A43B 13/141; A43B 13/223; A43B 13/122; A43B 13/36

See application file for complete search history.

(56) References Cited

U.S. PATENT DOCUMENTS

| | | | | |
|---|---|---|---|---|
| 3,824,716 | A * | 7/1974 | Di Paolo | B29D 35/081 36/32 R |
| 4,059,910 | A * | 11/1977 | Bryden | A43B 13/16 12/146 B |
| 4,306,360 | A * | 12/1981 | Hagger | A43B 5/001 36/134 |
| 8,356,426 | B1 * | 1/2013 | Daniel | A43B 13/16 36/15 |
| 9,504,239 | B2 | 11/2016 | Stender | |

(Continued)

FOREIGN PATENT DOCUMENTS

| | | |
|---|---|---|
| EP | 2739175 A1 | 6/2014 |
| JP | 2018007701 A | 1/2018 |

OTHER PUBLICATIONS

European Patent Office (ISA), International Search Report and Written Opinion for App. No. PCT/US2020/057975, dated Feb. 4, 2021.

*Primary Examiner* — Ted Kavanaugh

(74) *Attorney, Agent, or Firm* — Honigman LLP; Matthew H. Szalach; Jonathan P. O'Brien

(57) ABSTRACT

An outsole for an article of footwear includes a main body having a plurality of modules arranged in series from a first end to a second end, adjacent ones of the modules detachably connected to each other along one of a plurality of seams extending from a first side of the main body to a second side of the main body. The outsole further including at least one insert embedded in each of the modules and configured for selectively attaching a traction element to the outsole.

20 Claims, 9 Drawing Sheets

(56) References Cited

U.S. PATENT DOCUMENTS

| | | | | |
|---|---|---|---|---|
| 2010/0192415 | A1* | 8/2010 | James | A43B 1/0072 36/103 |
| 2011/0035963 | A1 | 2/2011 | Baker | |
| 2018/0000191 | A1 | 1/2018 | Bacon | |

* cited by examiner 20
10a
300a
200a
18
136
136
104
106
100
122d
136
122c
136
122b
136
104
122a
106

MODULAR OUTSOLE FOR ARTICLE OF FOOTWEAR

CROSS REFERENCE TO RELATED APPLICATION

This application claims priority under 35 U.S.C. § 119(e) to Provisional U.S. Patent Application No. 62/929,512, filed Nov. 1, 2019, the disclosure of which is hereby incorporated by reference in its entirety.

FIELD

The present disclosure relates generally to an article of footwear, and more particularly to a modular outsole for attachment to an article of footwear.

BACKGROUND

This section provides background information related to the present disclosure and is not necessarily prior art.

Articles of footwear conventionally include a support structure (e.g., an upper) for securing the article of footwear to a foot or leg, and a sole structure for providing traction and cushioning between the support structure and the ground surface. The sole structures generally include a layered arrangement extending between a ground surface and the support structure. For example, a sole structure may include a midsole and an outsole.

The midsole is generally disposed between the outsole and the support structure and provides cushioning for the foot. The midsole may include one or more cushioning components, such as foam elements and/or fluid-filled bladders. The outsole provides abrasion-resistance and traction with the ground surface and may be formed from rubber or other materials that impart durability and wear-resistance, as well as enhancing traction with the ground surface.

While known outsoles have proven acceptable for their intended purposes, a need exists for an outsole that can be easily adapted to a particular type of an article footwear or for a particular purpose. For example, conventional outsoles provide a wearer with little to no ability to modify or otherwise change the shape and/or configuration of the outsole regardless of whether the outsole is intended for use with a conventional article of footwear or for use with a prosthesis such as a prosthetic blade. Accordingly, a wearer is not able to tailor the outsole for use in a particular activity (i.e., sprinting versus long-distance running).

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
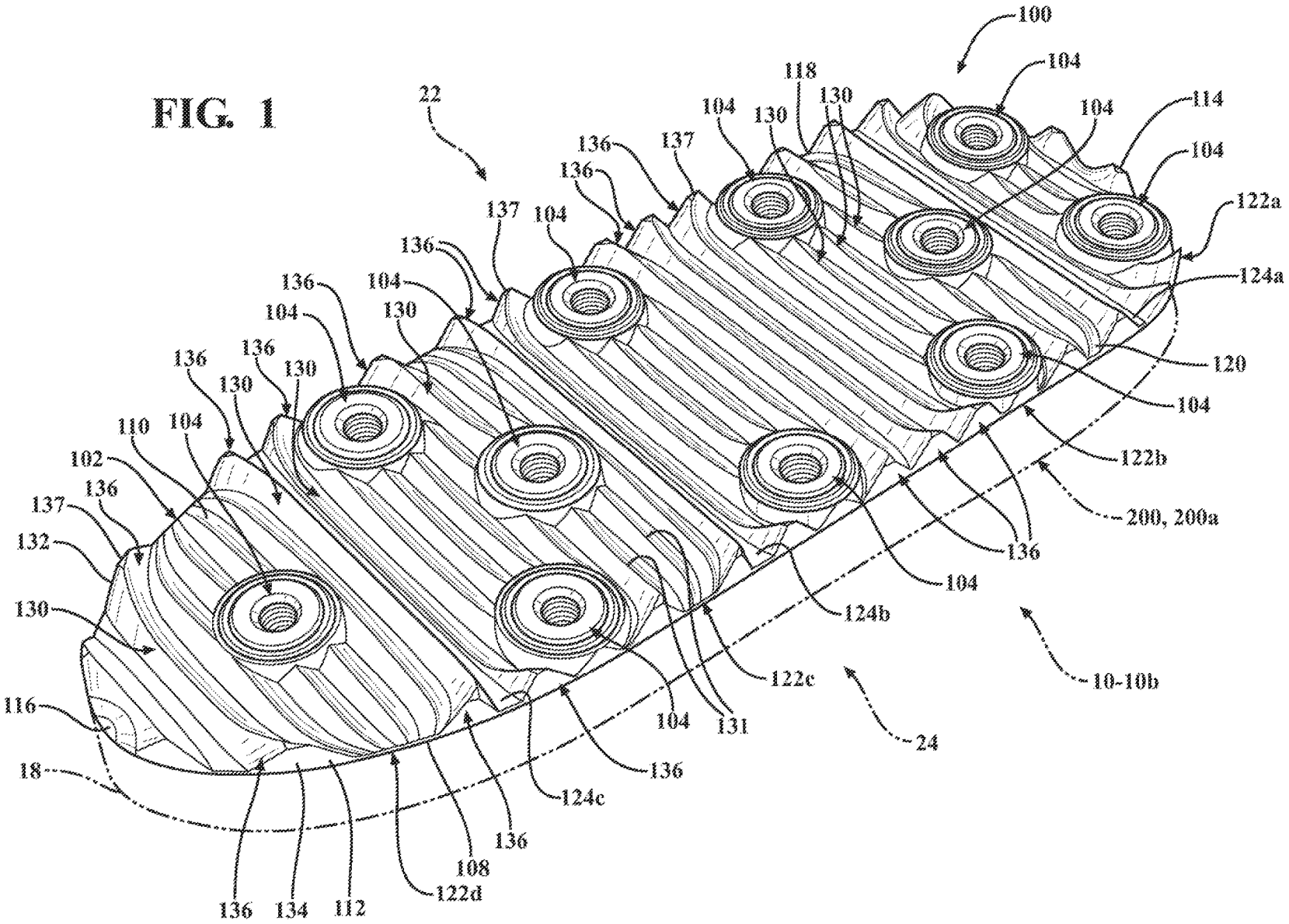
FIG. 1 is a perspective view of an outsole for an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an outsole for an article of footwear, the outsole including a main body having a plurality of modules arranged in series from a first end to a second end, adjacent ones of the modules detachably connected to each other along one of a plurality of seams extending from a first side of the main body to a second side of the main body. The outsole further including at least one insert embedded in each of the modules and configured for selectively attaching a traction element to the outsole.

The outsole may include one or more of the following optional features. Namely, each of the modules may include a plurality of ribs extending from a first terminal end at the first side of the main body to a second terminal end at the second side of the main body. The main body may include a top side and a bottom side formed on an opposite side of the main body from the top side, the plurality of ribs being formed on the bottom side of the main body. At least one of the first terminal end and the second terminal end may be flat and may extend perpendicular to the top side of the main body.

In one configuration, at least one of the plurality of ribs of each of the modules may include a first traction element formed at the first terminal end and a second traction element formed at the second terminal end. The at least one of the plurality of the ribs may be disposed at a first end of each of the modules, adjacent to one of the plurality of seams.

The plurality of ribs of each of the modules may include a first rib disposed at a first end of each module and a second rib disposed at a second end of each module, the first rib including a first traction element disposed at the first side and a second traction element disposed at the second side and the second rib including a third traction element disposed at the first side and a fourth traction element disposed at the second side.

In one configuration, the plurality of modules may include (i) a first module formed at a first end of the main body and having a first length, (ii) a second module detachably connected to the first module along a first one of the plurality of seams and having a second length, and (iii) a third module detachably connected to the second module along a second one of the plurality of seams and having a third length. At least one of the first length, the second length, and the third length may be different than the other of the first length, the second length, and the third length. Additionally or alternatively, the second module may include a first portion having a first plurality of the inserts and a second portion having a second plurality of the inserts, the first portion isolated from the second portion by a series of ribs.

In another aspect of the disclosure, an article of footwear is provided and includes a midsole having a bottom surface and an outsole attached to the bottom surface of the midsole and including a main body having a series of modules each including at least one insert configured for selectively attaching a traction element to the outsole, adjacent ones of the modules detachably connected to each other along one of a plurality of seams extending from a first side of the main body to a second side of the main body.

This aspect of the disclosure may include one or more of the following optional features. For example, each of the modules may include a plurality of ribs each extending from a first terminal end at the first side of the main body to a second terminal end at the second side of the main body. The main body may include a top side and a bottom side formed on an opposite side of the main body from the top side, the plurality of ribs being formed on the bottom side of the main body. At least one of the first terminal end and the second terminal end may be flat and may extend perpendicular to the top side of the main body.

In one configuration, at least one of the plurality of ribs of each of the modules may include a first traction element formed at the first terminal end and a second traction element formed at the second terminal end. Additionally or alternatively, the at least one of the plurality of the ribs may be disposed at a first end of each of the modules, adjacent to one of the plurality of seams.

The plurality of ribs of each of the modules may include a first rib disposed at a first end of each module and a second rib disposed at a second end of each module, the first rib including a first traction element disposed at the first side and a second traction element disposed at the second side and the second rib including a third traction element disposed at the first side and a fourth traction element disposed at the second side.

In one configuration, the series of modules may include (i) a first module formed at a first end of the main body and having a first length, (ii) a second module detachably connected to the first module along a first one of the plurality of seams and having a second length, and (iii) a third module detachably connected to the second module along a second one of the plurality of seams and having a third length. At least one of the first length, the second length, and the third length may be different than the other of the first length, the second length, and the third length.

The second module may include a first portion having a first plurality of the inserts and a second portion having a second plurality of the inserts, the first portion isolated from the second portion by a series of ribs.

In one configuration, the bottom surface of the midsole may be curved along a direction from an anterior end to a posterior end. Additionally or alternatively, at least a portion of the bottom surface of the midsole is flat.

The details of one or more implementations of the disclosure are set forth in the accompanying drawings and the description below. Other aspects, features, and advantages will be apparent from the description, the drawings, and the claims.

Referring to FIGS. 1-4, an outsole 100 for an article of footwear **10-10*b* is provided. In some instances, the outsole 100 is provided as a standalone component that can be modified prior to attachment to the article of footwear 10-10*b* depending on the type of footwear and/or the intended use. As described below with respect to FIGS. 6-11, the outsole 100 may be used in conjunction with a prosthesis such as a prosthetic blade 30 or with a conventional article of footwear 10*a*, 10*b*. The prosthetic blade 30 may include a different size and/or shape when used in conjunction with a prosthetic blade 30 as compared to the size and/or shape of the outsole 100 when used in conjunction with the articles of footwear 10*a*, 10*b***.

While FIGS. 1-4 are directed towards the outsole 100, features and elements of the outsole 100 may be described relative to the prosthetic blade 30 or the articles of footwear **10*a*-10*b* (shown in phantom) to which the outsole 100 may be attached. Particularly, elements and features of the outsole 100 may be described relative to a forefoot region 12, a mid-foot region 14, and a heel region 16 of the prosthetic blade 30 or the articles of footwear 10***a*-10*b*.

The forefoot region 12 may include a toe portion $\mathbf{12}_T$ corresponding with toes, and a ball portion $\mathbf{12}_B$ corresponding with joints connecting metatarsal bones with phalanx bones of a foot. The mid-foot region 14 may correspond with an arch area of the foot, and the heel region 16 may correspond with rear portions of the foot, including a calcaneus bone. Additionally, the outsole 100 may be described relative to an anterior end 18 formed at a foremost portion of the forefoot region 12 and a posterior end 20 formed at a rearmost portion of the heel region 16. Lateral and medial sides 22, 24 of the articles of footwear 10*a*-10*b* correspond to lateral and medial sides of a respective leg or foot to which the articles of footwear 10*a*-10*b* are attached. Likewise, lateral and medial sides 22, 24 of the prosthetic blade 30 correspond to lateral and medial sides of a respective leg to which the prosthetic blade 30 is attached.

With reference to FIG. 1, the outsole 100 includes a main body 102 and a plurality of inserts 104 disposed within the main body 102. The inserts 104 are each configured for selectively attaching a traction element 106 (FIGS. 6-11), such as a stud or cleat, to the outsole 100. The main body 102 may be formed of an elastomeric material, while the inserts 104 are formed of a second material having a greater hardness than the first material. In some examples, the first material is a polyether block amide (PEBA), such as PEBAX® Brand elastomers produced by Arkema S.A. The inserts 104 may be formed of any material suitable for engaging and supporting the studs 106, such as a metal.

Referring to FIGS. 1-4, the main body 102 may be described as including a top side 108, a bottom side 110 formed on an opposite side than the top side 108, and a peripheral side 112 extending from the top side 108 to the bottom side 110 and defining an outer peripheral profile of the main body 102 and the outsole 100. Generally, the top side 108 includes a continuous smooth surface and is configured to attach to the prosthetic blade 30 or the article of footwear 10*a*-10*b*, as discussed below. In some instances, the top side 108 is provided with one or more adhesives for bonding the top side 108 to a corresponding surface on a bottom of the prosthetic blade 30 or the article of footwear 10*a*-10*b*. Optionally, the outsole 100 may include a pre-applied adhesive covered by a removable sheet, such that a user can remove and discard the sheet to expose the adhesive immediately before attaching the outsole 100 to the prosthetic blade 30 or the article of footwear 10*a*-10*b*. The bottom side 110 is configured to engage a ground surface and includes one or more traction elements for providing traction, as described in greater detail below.

Figure 2:
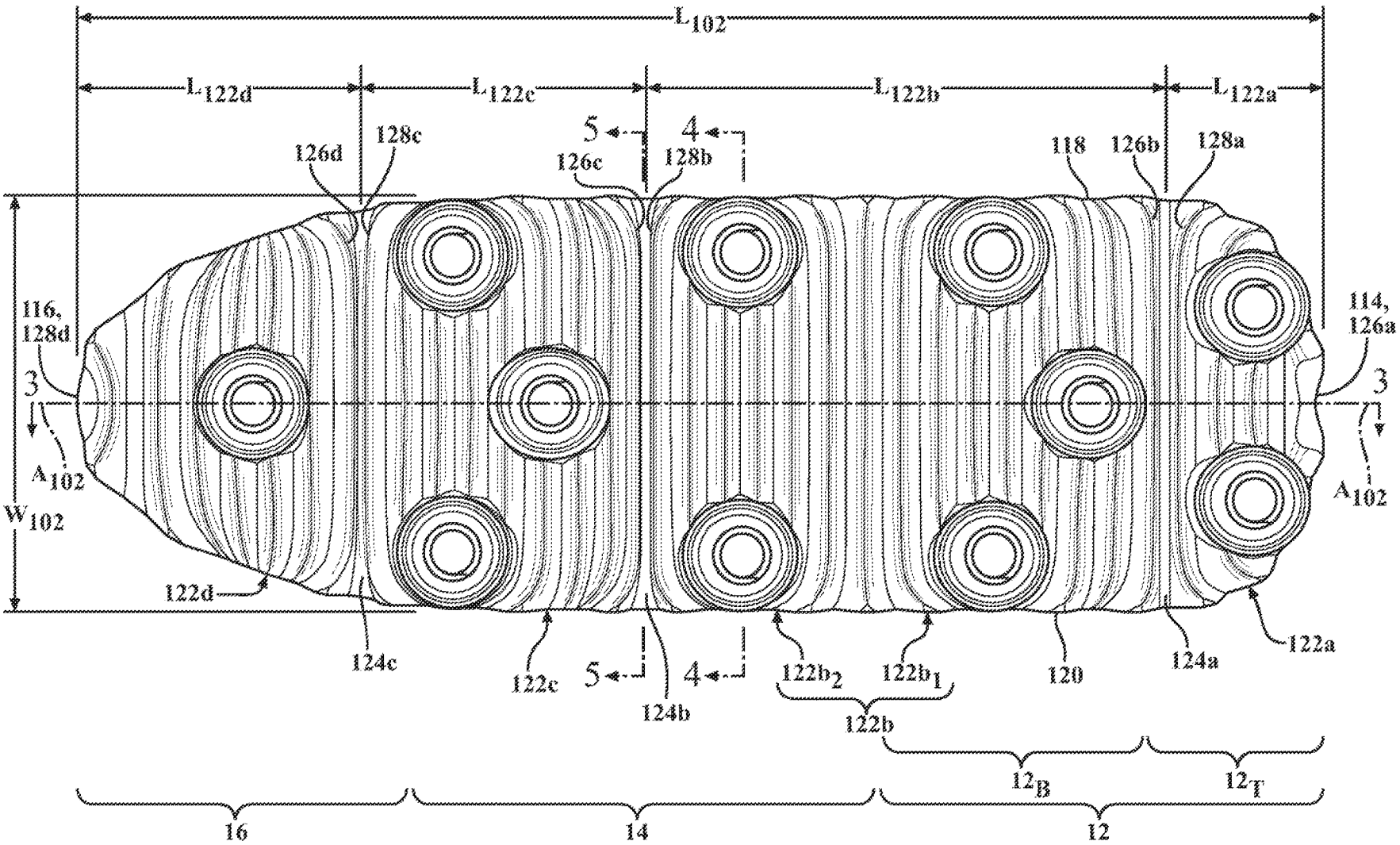
FIG. 2 is a bottom plan view of the outsole of FIG. 1.

As shown in FIG. 2, a length $L_{102}$ of the main body 102 extends along a longitudinal axis $A_{102}$ from a first end 114 to a second end 116. As described in greater detail below, when attached to one of the articles of footwear 10*a*-10*b* or the prosthetic blade 30, the first end 114 is configured to be disposed in the forefoot region 12 at the anterior end 18 of the article of footwear or blade, and the second end 116 is configured to be disposed in the heel region 16 at the posterior end 20. Accordingly, the first and second ends 114, 116 may also be referred to as anterior and posterior ends 114, 116 of the main body 102, respectively.

A width $W_{102}$ of the main body 102 extends perpendicular to the longitudinal axis $A_{102}$ from a first side 118 to a second side 120. When the outsole 100 is attached to the article of footwear 10*a*-10*b* or the prosthetic blade 30, the first side 118 is configured to be disposed along a lateral side 22 of the footwear 10*a*-10*b* or blade 30 and the second side 120 is configured to be disposed along a medial side 24 of the footwear 10*a*-10*b* or blade 30. Accordingly, the first and second sides 118, 120 may also be referred to as lateral and medial sides 118, 120, respectively. In other words, the width $W_{102}$ of the main body 102 is configured to extend entirely across a width of the article of footwear 10*a*-10*b* or prosthetic blade 30. While the sides 118, 120 of the outsole are shown as substantially straight, such that the outsole 100 has a constant width $W_{102}$, one or both of the sides may have a contour corresponding to an outer profile of a foot.

Figure 3:
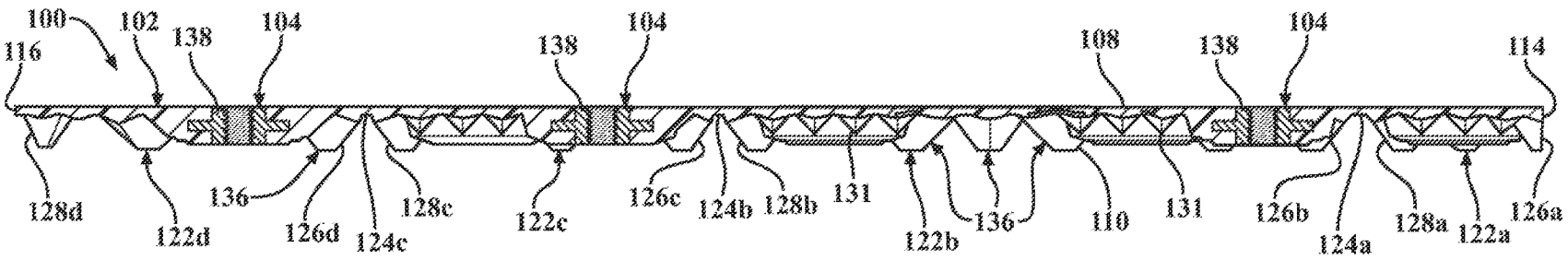
FIG. 3 is a cross-sectional view of the outsole of FIG. 1, taken along section line 3-3 in FIG. 2.

With continued reference to FIGS. 1-4, the main body 102 includes a plurality of modules 122*a*-122*d* arranged in series, whereby adjacent ones of the modules 122*a*-122*d* are attached to each other along respective seams 124*a*-124*c*. As shown in FIGS. 1-3, the main body 102 includes a first module 122*a* disposed at the first end 114 of the main body 102, a second module 122*b* connected to the first module 122*a* along a first seam 124*a*, a third module 122*c* connected to the second module 122*b* along a second seam 124*b*, and a fourth module 122*d* disposed at the second end 120 of the main body 102 and connected to the third module 122*c* along a third seam 124*c*.

With reference to the cross-sectional view of FIG. 3, each of the seams 124*a*-124*c* is formed by a portion of the main body 102 having a reduced thickness relative to the adjoining portions of the modules 122*a*-122*d*. The seams 124*a*-124*c* extend continuously from the first side 118 to the second side 120. Optionally, the seams may include perforations formed therethrough (not shown). Accordingly, the seams 124*a*-124*c* are configured to function as tear, cut, or break lines along which adjacent ones of the modules 122*a*-122*d* can be separated from each other to modify the overall length $L_{102}$ of the main body 102. For instance, any one or more of the modules 122*a*-122*d* may be separated from one or more of the other modules 122*a*-122*d* along one of the seams 124*a*-124*c*. As discussed below, this may be done in situations where a shortened portion of the outsole 100 is desired for attachment to the article of footwear 10*a*-10*b* or the prosthetic blade 30. Additionally, the seams 124*a*-124*c* may function to allow the outsole 100 to flex along the longitudinal axis $A_{102}$ to accommodate curved implementations (e.g., FIGS. 5 and 6) or bending of the outsole 100 during use.

Lengths $L_{122a}$-$L_{122d}$ of each of the modules 122*a*-122*d* extend from a respective first end 126*a*-126*d* facing the first end 114 of the main body 102, to a respective second end 128*a*-128*d* facing the second end 116 of the main body 102. Each module 122*a*-122*d* includes a respective series of laterally-extending (i.e., side-to-side) ribs 130 spaced along the length $L_{122a}$-$L_{122d}$ of the bottom side 110 of the module 122*a*-122*d*, from the first end 126*a*-126*d* to the second end 128*a*-128*d*. In the illustrated example, the ribs 130 are evenly and continuously spaced from the first end 126*a*-126*d* to the second end 126*a*-126*d*.

One or more of the ribs 130 may extend from a first terminal end 132 at the first side 118 of the main body 102 to a second terminal end 134 at the second side 120 of the main body 102. In some instances, one or more of the ribs 130 extends continuously from the first terminal end 132 to the second terminal end 134, while in other instances, some of the ribs 130 may be interrupted by one or more of the inserts 104. As best shown in FIG. 3, each of the ribs 130 has a triangular cross-sectional shape, such that each rib extends from a base portion having a first width at the bottom side 110, to a distal edge 131 facing away from the bottom side 110. Here, the bases of adjacent ones of the ribs 130 are connected to each other along the lengths of the ribs 130 from the first side 118 to the second side 120. The sharp distal edges 131 of the ribs 130 may function as traction elements.

As described in greater detail below with respect to individual ones of the modules 122*a*-122*d*, the main body 102 may include a plurality of cleats 136 formed along each of the sides 118, 120. In the illustrated example, each of the cleats 136 is integrally formed as a portion of one of the terminal ends 132, 134 of one of the ribs 130. Particularly, one of the cleats 136 may be formed at both terminal ends 132, 134 of one or more of the ribs 130. Here, the terminal ends 132, 134 formed by the cleats 136 are formed flush with the peripheral side 112 of the main body 102, and are substantially perpendicular (90 degrees±5 degrees) to the top side 108 (FIG. 5).

Figure 5:
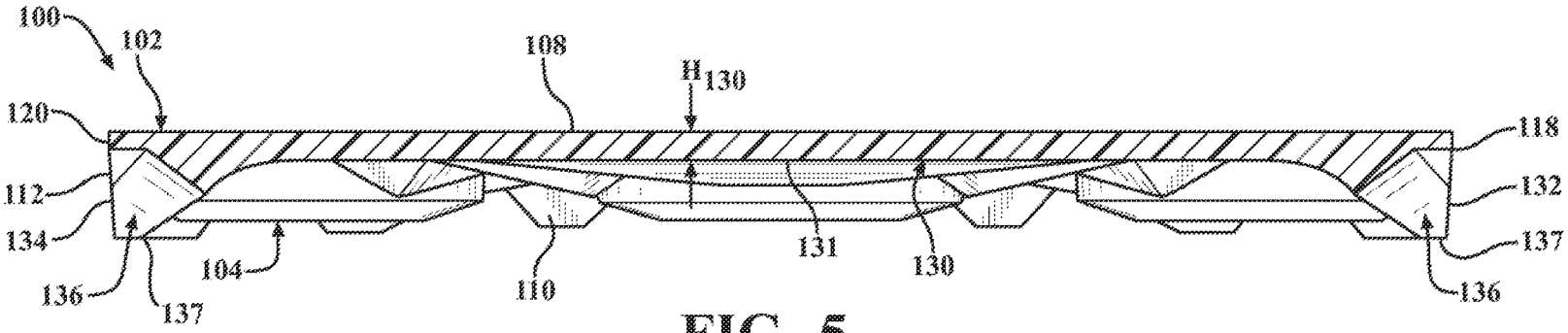
FIG. 5 is a cross-sectional view of the outsole of FIG. 1, taken along section line 5-5 in FIG. 2.

As best shown in FIG. 5, an intermediate portion of each of the ribs 130 has a substantially constant height $H_{130}$ between the first terminal end 132 and the second terminal end 134. Where the cleats 136 are included, the heights $H_{130}$ of the ribs 130 flare at each terminal end 132, 134 to a distal tip 137 that protrudes from the bottom side 110 of the main body 102. Additionally, each of the cleats 136 may widen and/or curve along a direction of the longitudinal axis $A_{102}$. For example, the cleats 136 may widen or curve around one of the inserts 104 adjacent to the terminal end 132, 134 of the rib 130. In some instances, this results in the cleats 136 formed on ribs at the first end 126*a*-126*d* and the second end 128*a*-128*d* curving away from the respective end 126*a*-126*d*, 128*a*-128*d* along which it is disposed. Thus, the cleats 136 disposed at opposite ends of a module 122*a*-122*d* will curve towards each other along the side 118, 120 of the main body 102.

Generally, each of the modules 122*a*-122*d* includes cleats 136 formed on the terminal ends 132, 134 of the ribs 130 disposed at the first end 126*a*-126*d* and the second end 128*a*-128, such that each module 122*a*-122*d* is bookended by a pair of the ribs 130 including the cleats 136. Thus, regardless of where the modules 122*a*-122*d* are separated from each other, the remaining modules 122*a*-122*d* that are attached to the article of footwear 10*a*-10*b* or the prosthetic blade 30 will include the cleats 136 disposed at least at each end 126*a*-126*d*, 128*a*-128*d*. Optionally, one or more intermediate ribs 130 may also include cleats 136, as discussed below.

Figure 4:
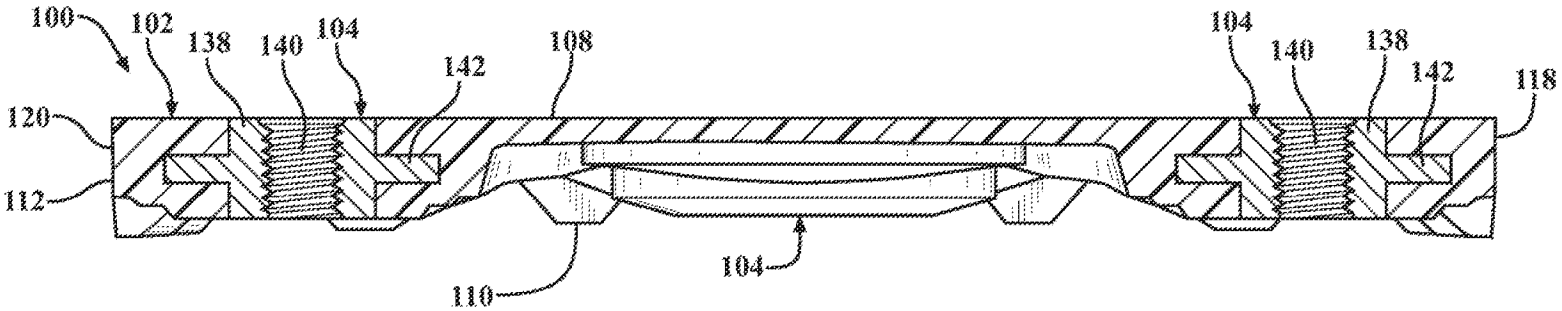
FIG. 4 is a cross-sectional view of the outsole of FIG. 1, taken along section line 4-4 in FIG. 2.

With continued reference to FIGS. 1 and 2, each of the modules 122*a*-122*d* includes one or more of the inserts 104 configured for selectively attaching a cleat or stud 106 to the outsole 100. In the illustrated example, each of the inserts 104 includes a helically-threaded aperture 140 configured for interfacing with a corresponding threaded shank of a stud 106. In other examples, the insert 104 may have other means for attaching to the stud 106. As provided above, each of the inserts 104 may be embedded within the material of the main body 102 during a molding process. As shown in FIG. 4, the inserts 104 include radially extending flanges 142 that are embedded in the material of the main body 102. Optionally, the main body 102 may be pre-molded with a plurality of sockets 138 within which the inserts 104 are disposed. In some examples, the inserts 104 may be placed into the sockets 138 after molding the main body 102 and attached using mechanical or chemical fastening means.

As best shown in FIG. 2, the inserts 104 are arranged along the bottom side 110 of the main body 102 in a manner that allows the outsole to flex along the ribs 130. Particularly, all of the inserts 104 are contained within the modules 122*a*-122*d* (i.e., disposed between the first ends 126*a*-126*d* and the second ends 128*a*-128*d*), such that the seams 124*a*-124*c* are uninterrupted. Thus, the main body 102 can freely flex at each of the seams 124*a*-124*c*. Additionally, the inserts 104 may be provided as laterally-aligned pairs disposed on opposite sides 118, 120 of the main body 102, where adjacent pairs of the inserts 104 are longitudinally separated from each other by a series of the ribs 130 such that the ribs 130 allow the main body 102 to bend in intermediate portions of the modules 122*a*-122*d* between the pairs of the inserts 104.

Referring now to FIGS. 1-3, the first module 122*a* is configured to be disposed adjacent to an anterior end 18 of the article of footwear 10*a*-10*b* or prosthetic blade 30. As shown, a first end 126*a* of the first module 122*a* is coincident with the first end 114 of the main body 102, and the second end 128*a* is disposed in an intermediate portion of the main body 102. A length $L_{122a}$ of the first module 122*a* corresponds to lengths of the toes of a foot, such that when the outsole 100 is incorporated in an article of footwear 10*a*-10*b*, the first seam 124*a* allows the first module 122*a* to flex with the toes. As shown, the first end 126*a* of the first module 122*a* may be arcuate, such that the first end 126*a* curves continuously around the main body 102 and converges with the second end 128*a* on each side 118, 120. The first module 122*a* includes a laterally-aligned pair of the inserts 104 disposed between the first end 126*a* and the second end 128*a*. As shown, one of the ribs 130 disposed along the second end 128*a* includes a pair of the cleats 136, which each widen and curve towards the first end 126*a*.

With continued reference to FIGS. 1-3, a length $L_{122b}$ of the second module 122*b* extends from a first end 126*b* attached to the first module 122*a* along the first seam 124*a* to a second end 128*b* associated with a mid-foot region 14 of the article of footwear 10*a*-10*b* or prosthetic blade 30. The length $L_{122b}$ of the second module 122*b* is greater than the length $L_{122a}$ of the first module 122*a*. Here, the second module 122*b* may be described as including a first portion $122b_1$ configured to be disposed in the ball portion $12_B$ of the article of footwear 10*a*-10*b* or prosthetic blade 30, and a second portion $122b_2$ configured to be disposed in an anterior end of the mid-foot region 14 of the article of footwear 10*a*-10*b* or prosthetic blade 30. The first portion $122b_1$ of the second module 122*b* includes a first set of inserts 104 that are isolated from a second set of inserts 104 of the second portion $122b_2$ by a plurality of the ribs 130. The first set of inserts 104 is disposed adjacent to the first end 126*b* and includes a central insert 104 at the first end 126*b* and a laterally-aligned pair of the inserts 104 spaced apart from the first end 126*b*, such that the first set of inserts 104 are arranged in a triangular pattern. The second portion $122b_2$ includes a second set of inserts 104 including a laterally-aligned pair of the inserts 104 disposed adjacent to the second end 128*b*. By isolating the first set of inserts 104 from the second set of inserts 104, the second module 122*d* can more easily flex along the intermediate portion.

As discussed above, the second module 122*b* includes a first rib 130 disposed at the first end 126*b* and a second rib 130 disposed at the second end 128*b*, where each of the first rib 130 and the second rib 130 includes a pair of the cleats 136 formed at the respective terminal ends 132, 134 of the rib 130. As shown, the cleats 136 of the first and second ribs 130 widen and curve around adjacent ones of the inserts 104 and towards an intermediate portion of the second module 122*b*. Additionally, the second module 122*b* includes the series of ribs 130 arranged between the first and second sets of inserts 104, where each of the ribs 130 of the series includes the cleats 136 formed at the respective terminal ends 132, 134. Here, the one or more ribs 130 closest to the first portion 122$b_1$ have cleats 136 that widen and curve towards the first portion 122$b_1$, the one or more ribs 130 closest to the second portion 122$b_2$ include cleats 136 that widen and curve towards the second portion 122$b_2$, and the one or more ribs disposed between the first portion 122$b_1$ and the second portion 122$b_2$ have cleats that widen and curve towards each of the first portion 122$b_1$ and the second portion 122$b_2$.

Referring still to FIGS. 1-3, a length $L_{122c}$ of the third module 122*c* extends from a first end 126*c* attached to the second module 122*b* along the second seam 124*b* in the mid-foot region 14, to a second end 128*c* adjacent to a portion of the outsole 100 corresponding to a heel region 16 of the article of footwear 10*a*-10*b* or prosthetic blade 30. The length $L_{122c}$ of the third module 122*c* is greater than the length $L_{122a}$ of the first module 122*a* and less than the length $L_{122b}$ of the second module 122*b*. The third module 122*c* includes a third set of inserts 104 disposed between the first end 126*c* and the second end 128*c*, which includes a central insert 104 at the first end 126*b* and a laterally-aligned pair of the inserts 104 at the second end 128*c*, such that the third set of inserts 104 includes a triangular pattern.

The third module 122*c* includes a first rib 130 at the first end 126*c* and a second rib 130 at the second end 128*c*, where each of the first rib 130 and the second rib 130 includes a pair of the cleats 136 formed at the respective terminal ends 132, 134 of the rib 130. As shown, the cleats 136 of the first and second ribs 130 widen and curve around adjacent ones of the inserts 104 and towards an intermediate portion of the third module 122*c*. The third module 122*c* may further include an intermediate rib 130 that is interrupted by the central insert 104 and includes the cleats 136 located at each terminal end 132, 134.

The fourth module 122*d* includes a first end 126*d* attached to the second end 128*c* of the third module 122*c* along the third seam 124*c*, and a second end 128*d* disposed adjacent to the second end 116 of the main body 102. Accordingly, a length $L_{122d}$ of the fourth module 122*d* is configured to extend along the heel region 16 of the article of footwear 10*a*-10*b* or prosthetic blade 30. The length $L_{122cd}$ of the fourth module 122*d* is substantially similar to the length $L_{122c}$ of the third module 122*c*. The fourth module 122*d* includes an insert 104 disposed in a central portion, between the first and second sides 118, 120 of the main body 102.

The fourth module 122*d* includes a first rib 130 at the first end 126*d* and a second rib 130 at the second end 128*d*. In the illustrated example, where the second end 128*d* is curved or arcuate from the first side 118 to the second side 120, the rib 130 at the second end 128*d* may be substantially straight such that an intermediate portion of the rib 130 is spaced apart from the second end 128*d*. Each of the first rib 130 and the second rib 130 includes a pair of the cleats 136 formed at the respective terminal ends 132, 134 the rib 130. As shown, the cleats 136 of the first and second ribs 130 widen and curve towards an intermediate portion of the fourth module 122*d*.

Figure 6:
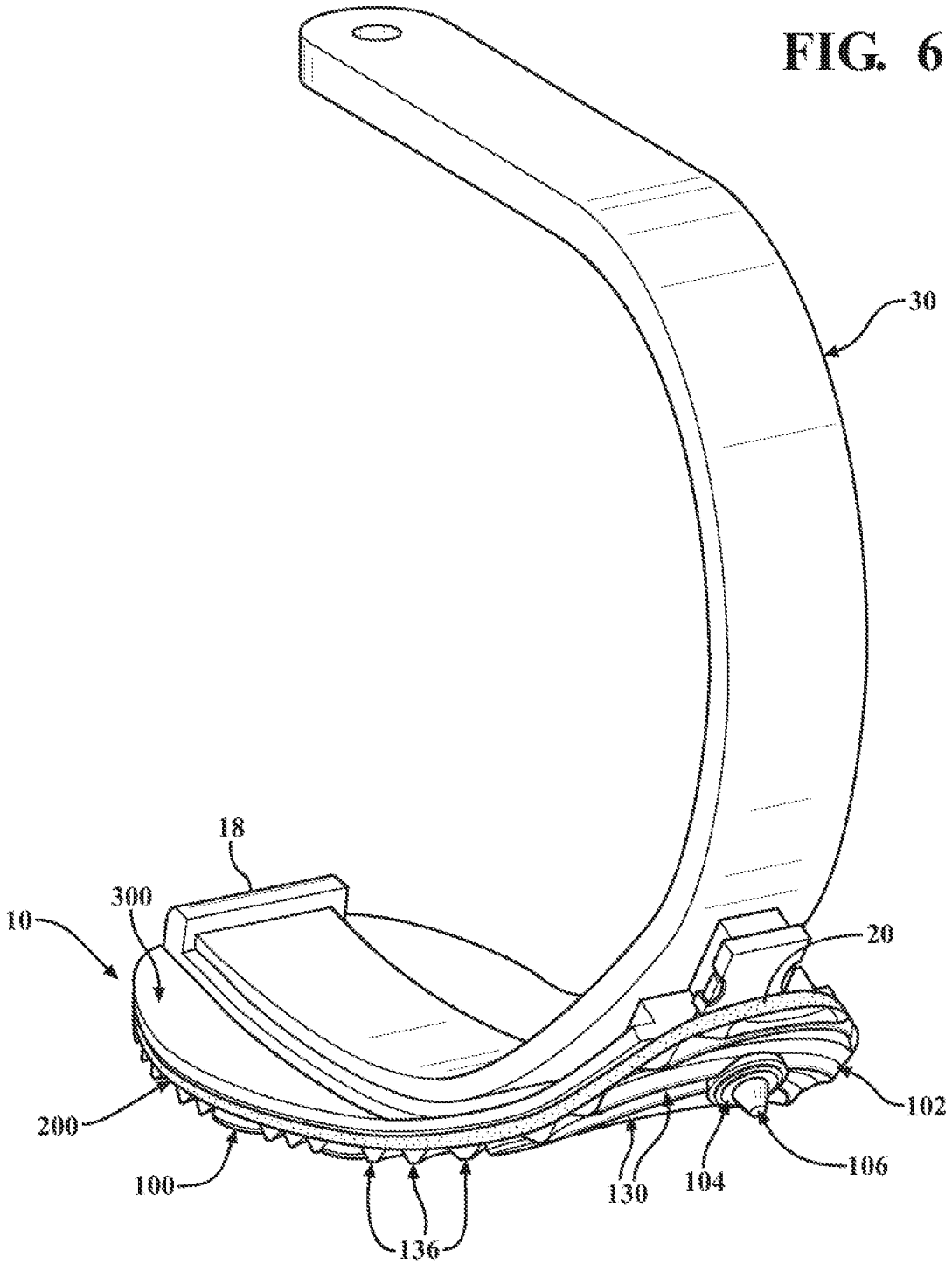
FIG. 6 is a perspective view of an article of footwear in accordance with principles of the present disclosure shown in conjunction with a prosthetic blade.
Figure 7:
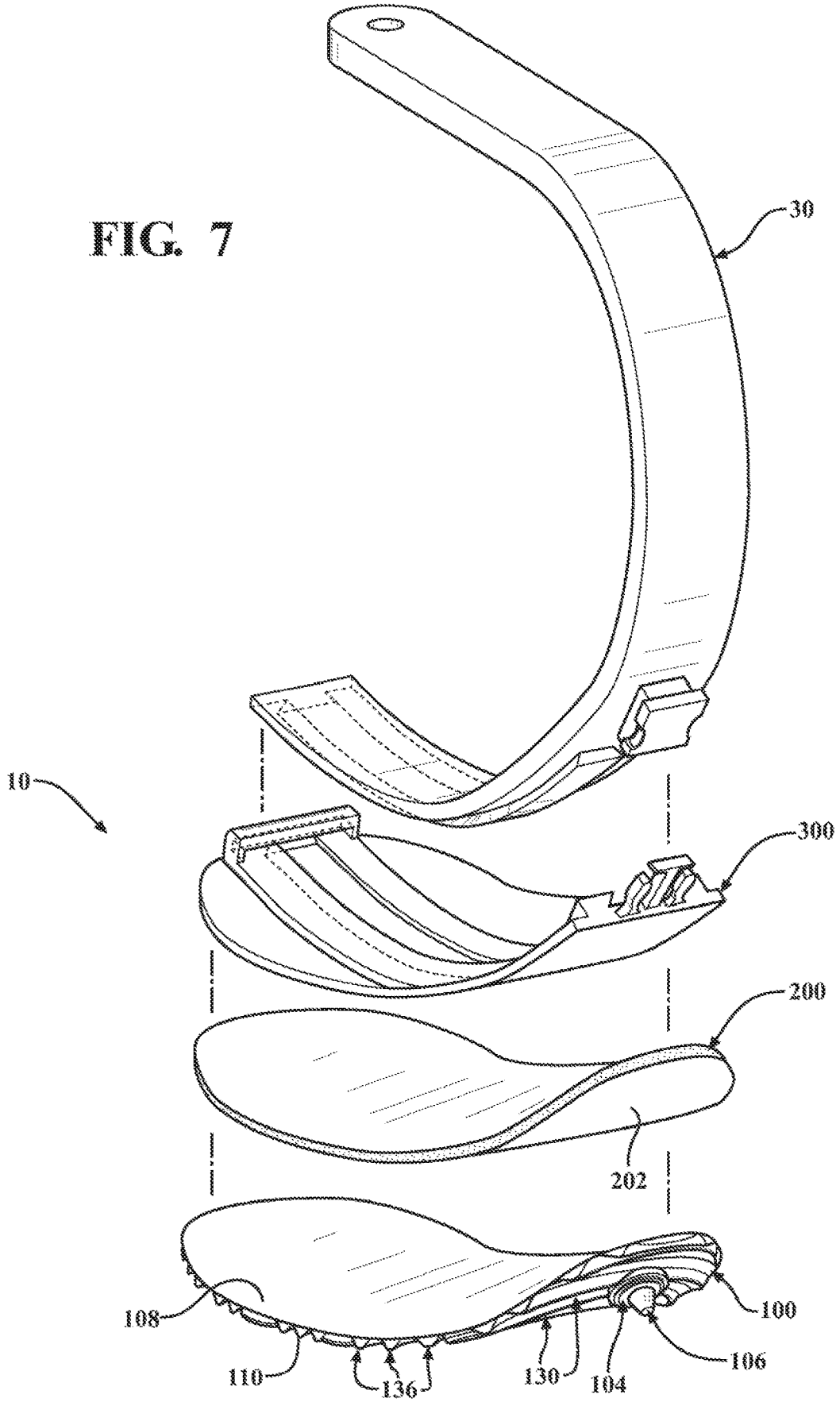
FIG. 7 is an exploded perspective view of the article of footwear of FIG. 6.

Referring now to FIGS. 6 and 7, the outsole 100 is shown in conjunction with the prosthetic blade 30. In some examples, the outsole 100 may be attached directly to a bottom surface of the prosthetic blade 30, where the width $W_{102}$ of the main body 102 is substantially the same as a width of the prosthetic blade 30 such that the outsole 100 is fully attached along the bottom of the prosthetic blade 30 to provide the blade 30 with traction elements.

Optionally, and as shown in FIGS. 6 and 7, the outsole 100 may be incorporated onto the prosthetic blade 30 using a detachable prosthetic foot 10. Here, the prosthetic foot 10 includes a midsole 200 providing one or more layers for cushioning and ground engagement, and a chassis 300 configured for securing the prosthetic foot 10 to the blade 30. As discussed above, the prosthetic foot 10 extends from an anterior end 18 to a posterior end 20.

The midsole 200 is attached to a lower portion of the chassis 300 and includes a bottom surface 202 formed on an opposite side of the midsole 200 from the chassis 300. As shown, at least a portion of the bottom surface 202 may be convex along a direction from the anterior end 18 to the posterior end 20. Thus, the bottom surface 202 is configured to provide continuous engagement between the prosthetic foot 10 and the ground surface as the prosthetic foot 10 rolls forward over the ground surface during running or walking.

In use, the outsole 100 is configured to be attached to the bottom surface 202 of the midsole 200 to provide the prosthetic foot 10 with a resilient ground-engaging surface including the traction elements 106, 136. As discussed above, the outsole 100 may initially be provided in a unitary state, where each of the modules 122*a*-122*d* are attached to each other along the respective seams 124*a*-124*c*. In the illustrated example, the outsole 100 is attached to the midsole 200 in the unitary state such that the outsole 100 extends continuously from the anterior end 18 to the posterior end 20. Here, the ribs 130 and the seams 124*a*-124*c* of the outsole 100 allow the outsole 100 to bend continuously along the convex bottom surface 202 of the midsole 200 such that the outsole 100 will mold to the profile of the bottom surface 202. Accordingly, when attached to the midsole 200, the bottom side 110 of the outsole 100 will also be convex.

While the outsole 100 of the illustrated example is shown in a unitary state, the outsole 100 of the present disclosure allows for one or more of the modules 122*a*-122*d* to be detached from the outsole 100 prior to or after attachment of the outsole 100 to the midsole 200. For example, the outsole 100 may be separated along any one or more of the seams 124*a*-124*c* so that one or more of the modules 122*a*-122*d* can be attached to a corresponding portion of the midsole 200 to provide the midsole 200 with the inserts 104.

Figure 8:
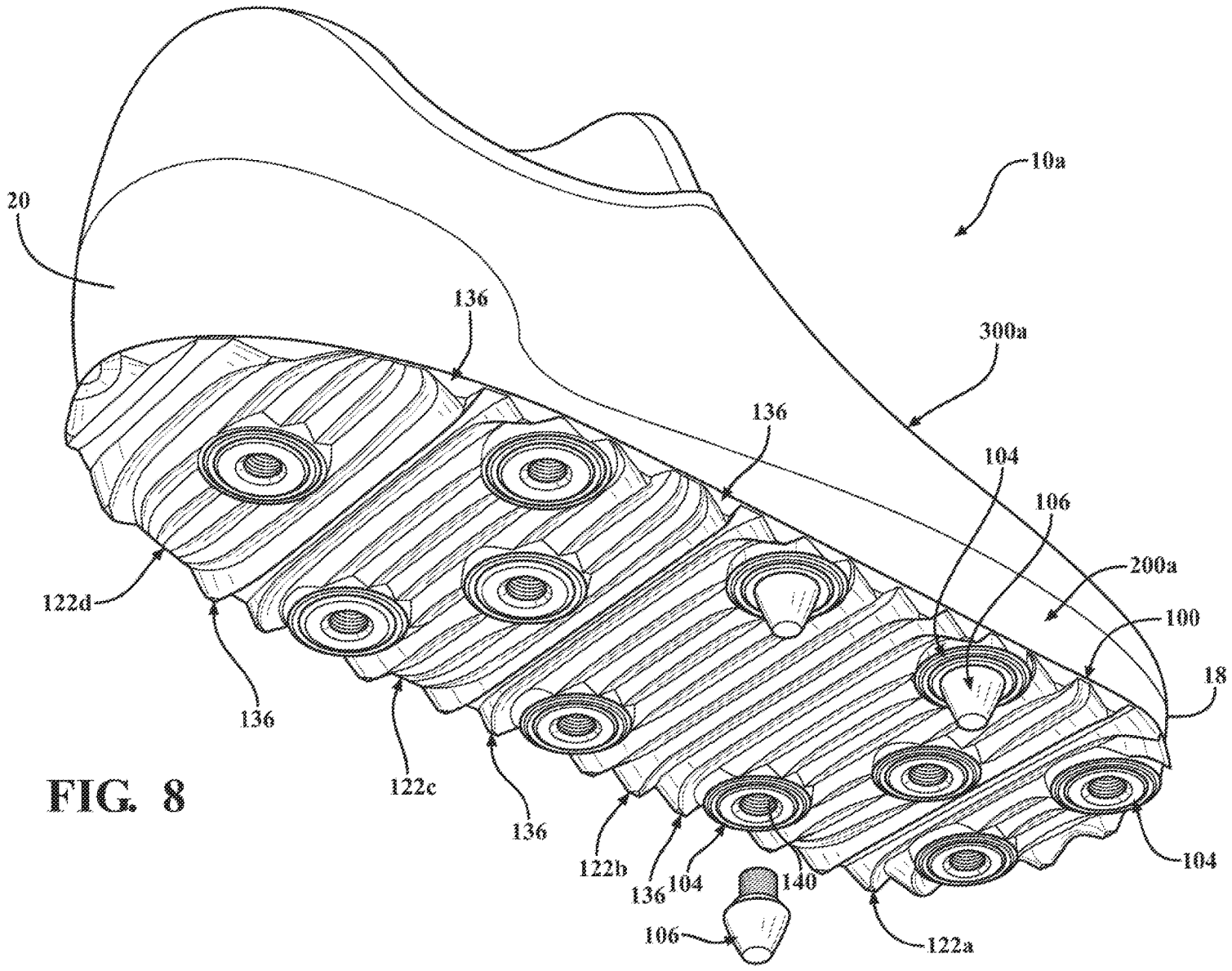
FIG. 8 is a perspective view of an article of footwear in accordance with principles of the present disclosure.
Figure 9:
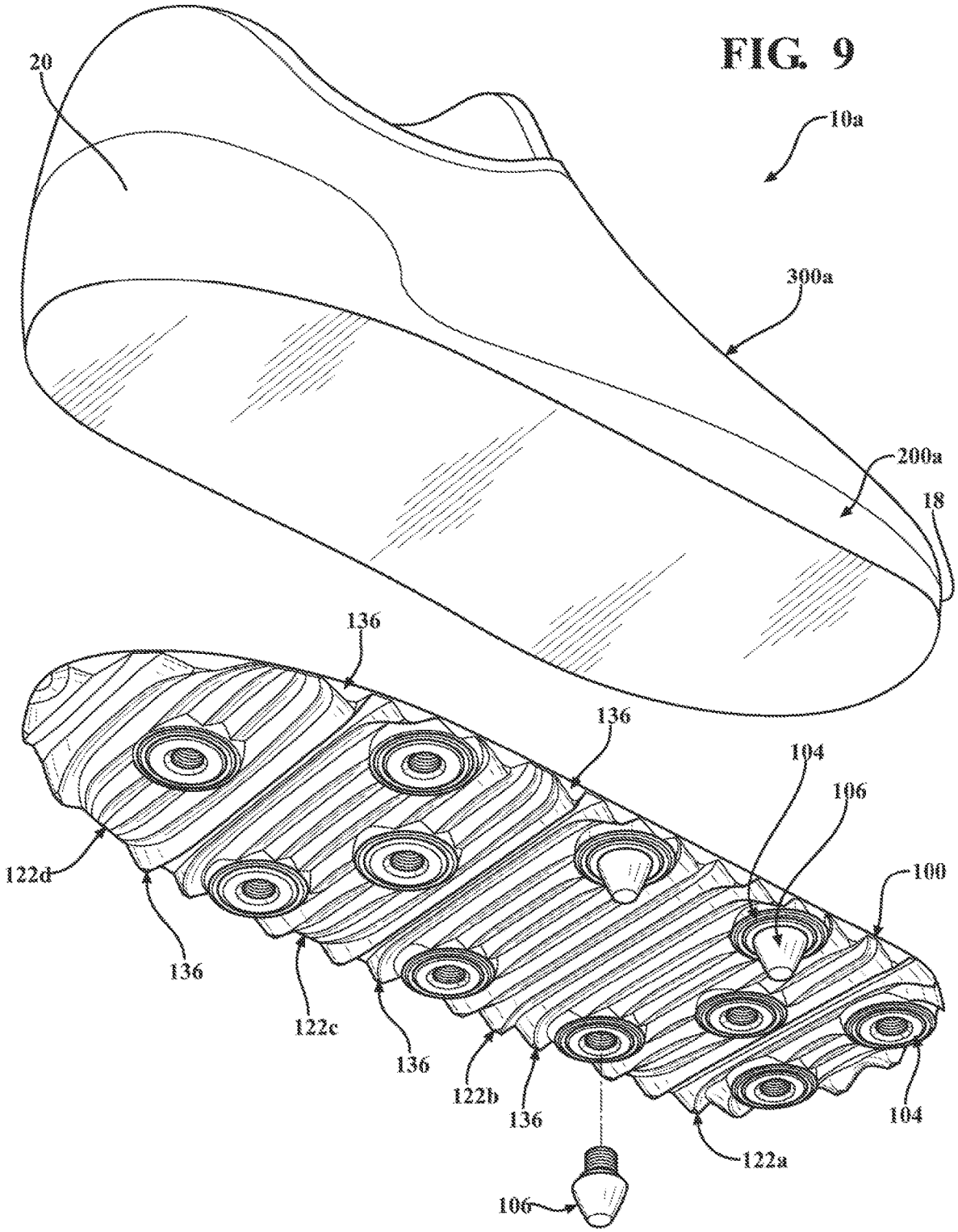
FIG. 9 is an exploded perspective view of the article of footwear of FIG. 8.

With particular reference to FIGS. 8 and 9, an article of footwear 10*a* is provided and includes the outsole 100, a midsole 200*a*, and a chassis 300*a*. Here, the article of footwear 10*a* is embodied as a conventional shoe, where the chassis 300*a* is an upper 300*a* configured for securing a foot of a user to the midsole 200*a*. The upper 300*a* is attached to the midsole 200*a* and includes interior surfaces that define an interior void configured to receive and secure a foot for support on the midsole 200*a*. The upper 300*a* may be formed from one or more materials that are stitched or adhesively bonded together to form the interior void. Suitable materials of the upper 300 may include, but are not limited to, mesh, textiles, foam, leather, and synthetic leather. The materials may be selected and located to impart properties of durability, air-permeability, wear-resistance, flexibility, and comfort.

In use, the outsole 100 may be initially provided in a unitary state, as shown in FIG. 9. The top side 108 of the main body 102 is then prepared for attachment to the bottom surface 202 of the midsole 200*a*, either by removing a cover sheet from the top side 108 to expose a pre-applied adhesive, or by applying an adhesive to the top side 108 and/or the bottom surface 202. The outsole 100 is then positioned on the bottom surface 202 of the midsole 200*a* so that the first module 122*a* is positioned at the anterior end 18 and the fourth module 122*d* is positioned at the posterior end 20, with the first and second sides 118, 120 of the outsole extending along lateral and medial sides 22, 24 of the midsole 202*a*. Alternatively, the outsole 100 may be attached to the midsole 200*a* during manufacturing of the article of footwear 10*a* in a conventional fashion by bonding the outsole 100 to the midsole 200*a* using a suitable adhesive.

Unlike the midsole 200 discussed above with respect to the prosthetic foot 10, the bottom surface 202 of the midsole 200*a* of the article of footwear 10*a* may be substantially flat, including slight curvatures at the anterior and posterior ends 18, 20 to accommodate the natural motion of the foot during walking and running. Accordingly, when the outsole 100 is attached to the bottom surface 202 of the midsole 200*a*, the first and fourth modules 122*a*, 122*d* may bend upwardly from the first and third seams 124*a*, 124*c*, while the second and third modules 122*c*, 122*d* are substantially flat along the intermediate portions of the midsole 200*a*. However, in instances where the midsole 200*a* includes contours along the intermediate portion, the ribs 130 of second and third modules 122*c*, 122*d* will allow the second and third modules 122*c*, 122*d* to flex to accommodate the contours.

Figure 10:
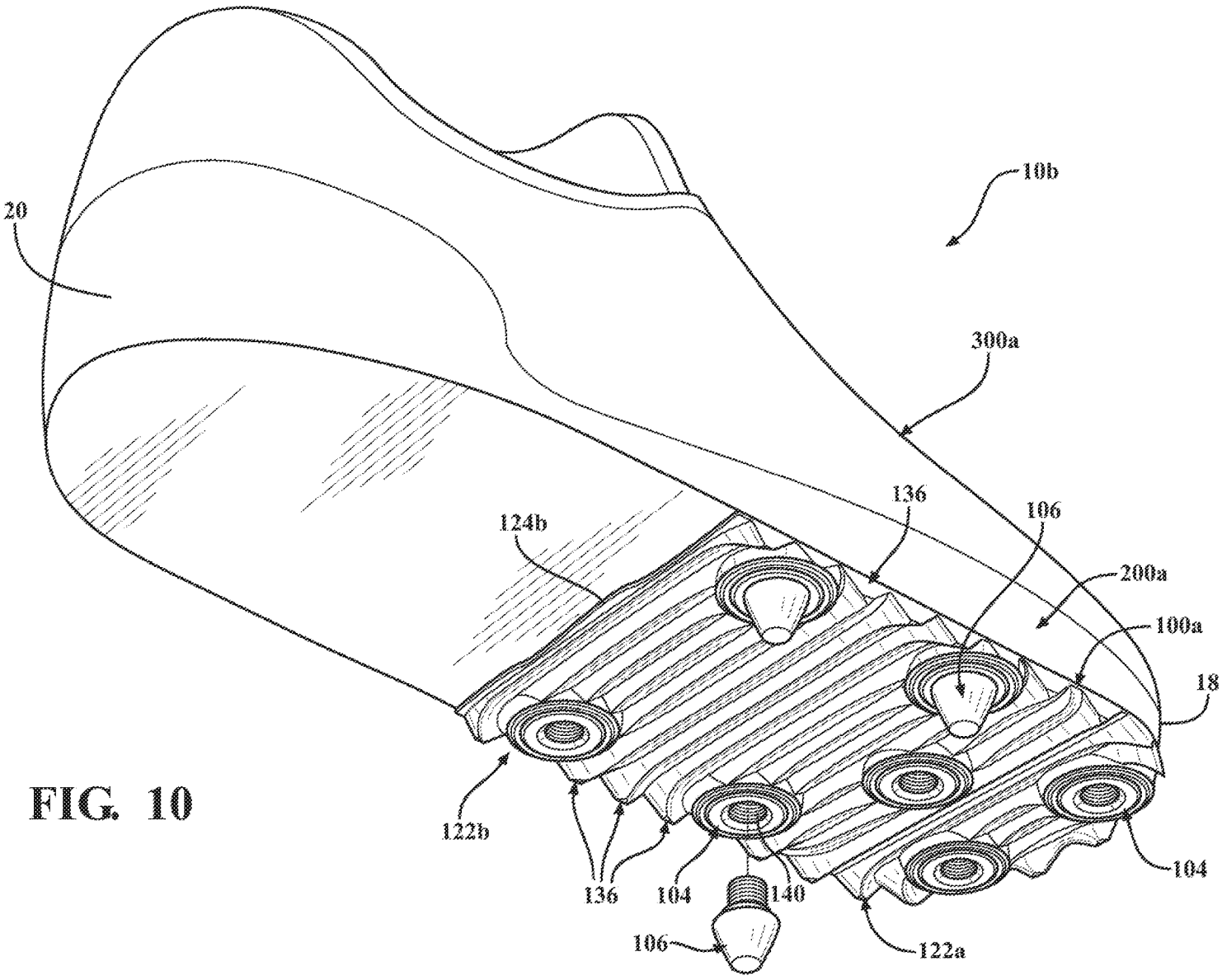
FIG. 10 is a perspective view of an article of footwear in accordance with principles of the present disclosure.
Figure 11:
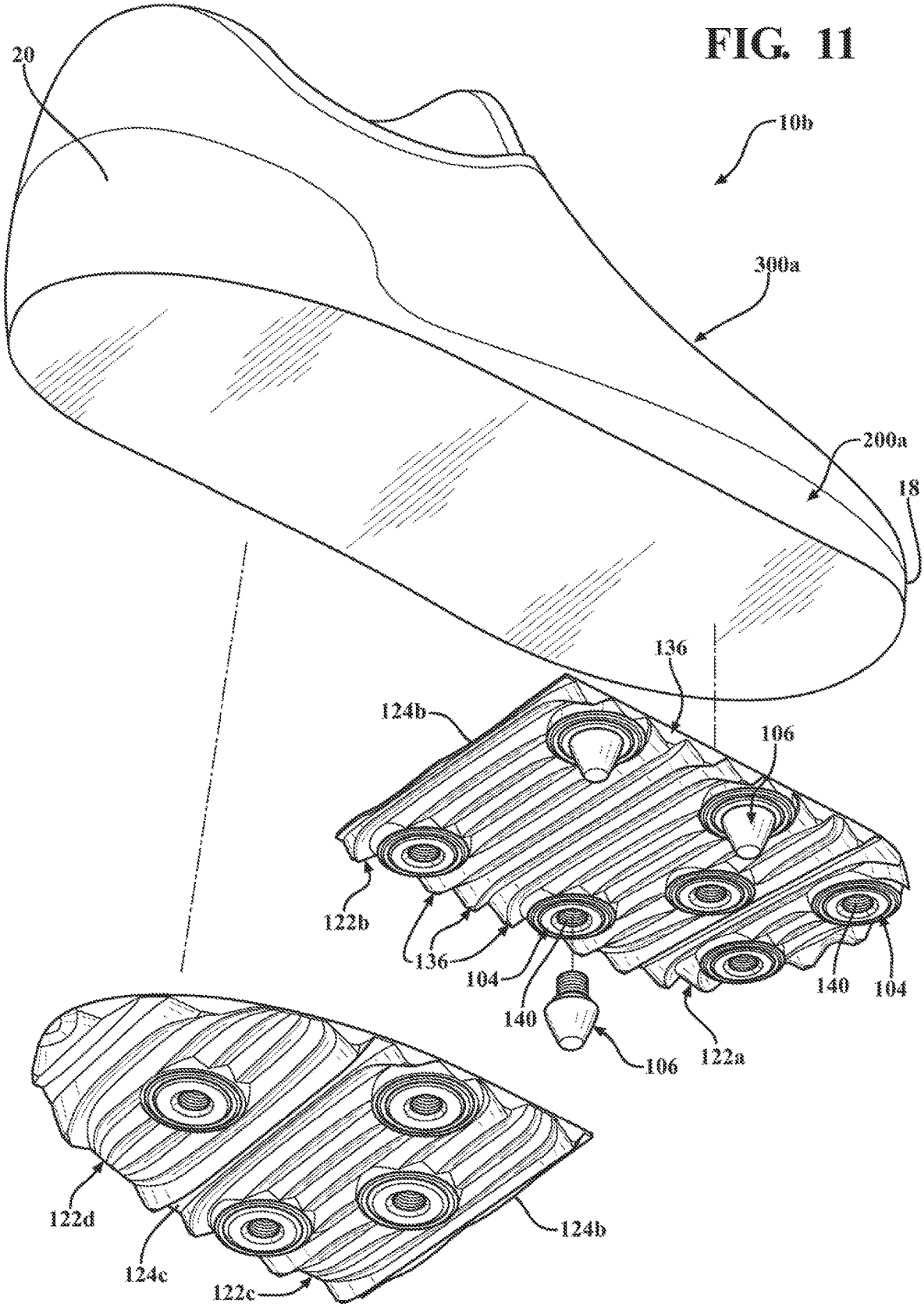
FIG. 11 is an exploded perspective view of the article of footwear of FIG. 10.

With particular reference to FIGS. 10 and 11, an article of footwear 10*b* is provided and includes the outsole 100*a*, the midsole 200*a*, and the chassis 300*a*. In this example, the outsole 100*a* is separated along the second seam 124*b* and the third and fourth modules 122*c*, 122*d* are discarded. Here, the first module 122*a* and the second module 122*b* are attached to the bottom surface 202 of the midsole 200*a* adjacent to the anterior end 18.

The following Clauses provide an exemplary configuration for a sole structure for an article of footwear or a prosthetic blade, as described above.

Clause 1: An outsole for an article of footwear, the outsole including: a main body including a plurality of modules arranged in series from a first end to a second end, adjacent ones of the modules detachably connected to each other along one of a plurality of seams extending from a first side of the main body to a second side of the main body; and at least one insert embedded in each of the modules and configured for selectively attaching a traction element to the outsole.

Clause 2: The outsole of Clause 1, wherein each of the modules includes a plurality of ribs extending from a first terminal end at the first side of the main body to a second terminal end at the second side of the main body.

Clause 3: The outsole of Clause 2, wherein the main body includes a top side and a bottom side formed on an opposite side of the main body from the top side, the plurality of ribs being formed on the bottom side of the main body.

Clause 4: The outsole of Clause 3, wherein at least one of the first terminal end and the second terminal end is flat and extends perpendicular to the top side of the main body.

Clause 5: The outsole of any one of Clauses 2-4, wherein at least one of the plurality of ribs of each of the modules includes a first traction element formed at the first terminal end and a second traction element formed at the second terminal end.

Clause 6: The outsole of Clause 5, wherein the at least one of the plurality of the ribs is disposed at a first end of each of the modules, adjacent to one of the plurality of seams.

Clause 7: The outsole of Clause 2, wherein the plurality of ribs of each of the modules includes a first rib disposed at a first end of each module and a second rib disposed at a second end of each module, the first rib including a first traction element disposed at the first side and a second traction element disposed at the second side and the second rib including a third traction element disposed at the first side and a fourth traction element disposed at the second side.

Clause 8: The outsole of any one of the preceding clauses, wherein the plurality of modules includes (i) a first module formed at a first end of the main body and having a first length, (ii) a second module detachably connected to the first module along a first one of the plurality of seams and having a second length, and (iii) a third module detachably connected to the second module along a second one of the plurality of seams and having a third length.

Clause 9: The outsole of Clause 8, wherein at least one of the first length, the second length, and the third length is different than the other of the first length, the second length, and the third length.

Clause 10: The outsole of any one of Clauses 8 or 9, wherein the second module includes a first portion having a first plurality of the inserts and a second portion having a second plurality of the inserts, the first portion isolated from the second portion by a series of ribs.

Clause 11: An article of footwear including: a midsole having a bottom surface; and an outsole attached to the bottom surface of the midsole and including a main body having a series of modules each including at least one insert configured for selectively attaching a traction element to the outsole, adjacent ones of the modules detachably connected to each other along one of a plurality of seams extending from a first side of the main body to a second side of the main body.

Clause 12: The article of footwear of Clause 11, wherein each of the modules includes a plurality of ribs each extending from a first terminal end at the first side of the main body to a second terminal end at the second side of the main body.

Clause 13: The article of footwear of Clause 12, wherein the main body includes a top side and a bottom side formed on an opposite side of the main body from the top side, the plurality of ribs being formed on the bottom side of the main body.

Clause 14: The article of footwear of Clause 13, wherein at least one of the first terminal end and the second terminal end is flat and extends perpendicular to the top side of the main body.

Clause 15: The article of footwear of any one of Clauses 12-14, wherein at least one of the plurality of ribs of each of the modules includes a first traction element formed at the first terminal end and a second traction element formed at the second terminal end.

Clause 16: The article of footwear of Clause 15, wherein the at least one of the plurality of the ribs is disposed at a first end of each of the modules, adjacent to one of the plurality of seams.

Clause 17: The article of footwear of Clause 12, wherein the plurality of ribs of each of the modules includes a first rib disposed at a first end of each module and a second rib disposed at a second end of each module, the first rib including a first traction element disposed at the first side and a second traction element disposed at the second side and the second rib including a third traction element disposed at the first side and a fourth traction element disposed at the second side.

Clause 18: The article of footwear of any one of Clauses 11-17, wherein the series of modules includes (i) a first module formed at a first end of the main body and having a first length, (ii) a second module detachably connected to the first module along a first one of the plurality of seams and having a second length, and (iii) a third module detachably connected to the second module along a second one of the plurality of seams and having a third length.

Clause 19: The article of footwear of Clause 18, wherein at least one of the first length, the second length, and the third length is different than the other of the first length, the second length, and the third length.

Clause 20: The article of footwear of any one of Clauses 18 or 19, wherein the second module includes a first portion having a first plurality of the inserts and a second portion having a second plurality of the inserts, the first portion isolated from the second portion by a series of ribs.

Clause 21: The article of footwear of any one of Clauses 11-20, wherein the bottom surface of the midsole is curved along a direction from an anterior end to a posterior end.

Clause 22: The article of footwear of any one of Clauses 11-20, wherein at least a portion of the bottom surface of the midsole is flat.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An outsole for an article of footwear, the outsole comprising:

a main body having a width extending from a first side to a second side and including a plurality of modules arranged in series between an anterior end of the outsole and a posterior end of the outsole, each module having a length extending from a first end including a first rib to a second end including a second rib, the first end of at least one of the modules connected to a second end of an adjacent one of the modules along a seam having a reduced thickness relative to the first rib and the second rib to define a straight break line extending continuously across the width of the main body and along which the first end of a first module can be separated from the second end of an adjacent second module, each of the ribs extending continuously across the width of the main body from a first terminal end including a first cleat to a second terminal end including a second cleat; and at least one insert embedded in each of the modules and configured for selectively attaching a traction element to the outsole.

2. The outsole of claim 1, wherein the first cleat of each rib is formed flush with the first side of the main body and the second cleat of each rib is formed flush with the second side of the main body.

3. The outsole of claim 2, wherein the main body includes a top side and a bottom side formed on an opposite side of the main body from the top side, each rib being formed on the bottom side of the main body.

4. The outsole of claim 3, wherein at least one of the first terminal end and the second terminal end is flat and extends perpendicular to the top side of the main body.

5. The outsole of claim 2, wherein each cleat is integrally formed with one of the ribs.

6. The outsole of claim 5, wherein each cleat includes at least one of a flared height or a flared width along a direction towards the corresponding terminal end.

7. The outsole of claim 5, wherein at least one of the cleats curves around the at least one insert.

8. The outsole of claim 1, wherein the plurality of modules includes a third module detachably connected to the second module along a second seam and having a third length.

9. The outsole of claim 1, wherein the seam includes a plurality of perforations.

10. The outsole of claim 1, wherein the seam includes a polyether black amide.

11. An article of footwear comprising:

a midsole having a bottom surface; and an outsole attached to the bottom surface of the midsole and including a main body having a width extending from a first side to a second side and including a series of modules each including at least one insert configured for selectively attaching a traction element to the outsole, each module having length extending from a first end including a first rib to a second end including a second rib, the first end of at least one of the modules connected to a second end of an adjacent one of the modules by a seam having a reduced thickness relative to the first rib and the second rib to define a break line extending continuously across the width of the main body along which the first end of a first module can be separated from the second end of an adjacent second module, each of the ribs extending continuously across the width of the main body from a first terminal end defining a first cleat to a second terminal end defining a second cleat.

12. The article of footwear of claim 11, wherein the first cleat of each rib is formed flush with the first side of the main body and the second cleat of each rib is formed flush with the second side of the main body.

13. The article of footwear of claim 12, wherein the main body includes a top side and a bottom side formed on an opposite side of the main body from the top side, each rib being formed on the bottom side of the main body.

14. The article of footwear of claim 13, wherein at least one of the first terminal end and the second terminal end is flat and extends perpendicular to the top side of the main body.

15. The article of footwear of claim 12, wherein each cleat is integrally formed with one of the ribs.

16. The article of footwear of claim 15, wherein each cleat includes at least one of a flared height or a flared width along a direction towards the corresponding terminal end.

17. The article of footwear of claim 15, wherein at least one of the cleats curves around the at least one insert.

18. The article of footwear of claim 11, wherein the series of modules includes a third module detachably connected to the second module along a second seam and having a third length.

19. The article of footwear of claim 11, wherein the seam includes a plurality of perforations.

20. The article of footwear of claim 11, wherein the seam includes a polyether black amide.

* * * * *